US005823377A

United States Patent [19]

Krautkrämer

[11] Patent Number: 5,823,377

[45] Date of Patent: Oct. 20, 1998

[54] SCREW CAP HAVING A TAMPER RESISTANT CONNECTION TO A PLASTIC CONTAINER

[75] Inventor: Günter Jakob Krautkrämer, Budenheim, Germany

[73] Assignee: Jacob Berg GmbH & Co. KG, Budenheim, Germany

[21] Appl. No.: 410,320

[22] Filed: Mar. 24, 1995

[30] Foreign Application Priority Data

Mar. 28, 1994 [DE] Germany ..... P 44 10 790.0

[51] Int. Cl.[6] ..... B65D 17/32; B65D 17/40; B65D 41/34

[52] U.S. Cl. ..... 220/268; 215/232; 215/256; 220/270; 220/276; 220/359; 222/530; 222/541.5

[58] Field of Search ..... 222/530, 541.5, 222/541.6, 541.9; 129/125.13, 125.15, 125.19; 215/232, 256; 220/288, 359, 676, 661, 265, 266, 270, 276, 268

[56] References Cited

U.S. PATENT DOCUMENTS

| | | | |
|---|---|---|---|
| 3,974,008 | 8/1976 | Choksi | 220/266 X |
| 4,044,941 | 8/1977 | Knudsen | 215/232 X |
| 4,141,463 | 2/1979 | Smith | 220/359 |
| 4,332,332 | 6/1982 | Ingemann | 220/359 X |
| 4,344,472 | 8/1982 | Larkin et al. | 220/266 |
| 4,422,563 | 12/1983 | Babiol | 220/530 X |
| 4,632,282 | 12/1986 | Nagashima | 222/530 X |
| 4,726,481 | 2/1988 | Hagan | 215/232 |
| 4,757,911 | 7/1988 | Larkin et al. | 220/265 |
| 5,052,572 | 10/1991 | Pherigo | 220/266 X |
| 5,101,993 | 4/1992 | Nairn et al. | 215/232 |
| 5,115,934 | 5/1992 | Nelson | 220/266 X |
| 5,152,438 | 10/1992 | Gordon et al. | 215/232 X |
| 5,249,695 | 10/1993 | Luch et al. | 220/266 X |
| 5,287,983 | 2/1994 | Reil et al. | 215/232 X |

*Primary Examiner*—Allan N. Shoap
*Assistant Examiner*—Niki M. Kopsidas
*Attorney, Agent, or Firm*—Michael L. Dunn

[57] ABSTRACT

A plastic screw cap for the closure of a plastic container is provided for the closure of a container made of plastics. The screw cap has a simple configuration similar to corresponding closures for metal containers, but nevertheless ensures stable and sealed seating of the closure on the container opening. The screw cap is provided with an extension, extending radially over the side of the screw cap, which is made from a material which can be welded to the material from which the container lid is made.

10 Claims, 4 Drawing Sheets

SCREW CAP HAVING A TAMPER RESISTANT CONNECTION TO A PLASTIC CONTAINER

BACKGROUND OF THE INVENTION

The present invention relates to a plastic screw cap for closure of a plastic container and also a screw cap closure as a whole, and to a plastic container provided with such a closure.

Many embodiments of closures for plastic containers are known. Plastic bottles are known which have a tapering neck not substantially larger than the diameter of the cap, at Least in tie area directly below the cap, and therefore are not relevant to the present invention. Canisters, buckets and the like are also known which have a one-section closure, herein referred to as a lid. Such container closures made of plastic material may be inserted or placed on a short connection piece. So-called bellows closures are particularly frequently used. which are inserted together with a sealing foot into a container opening wherein the sealing foot is connected by means of a: collapsible bellows to a pouring spout onto which in turn a screw cap is screwed. During storage and transport the pouring spout, together with the screwed-on cap, is pushed as far down as possible into the container opening, while collapsing the bellows, so that the top edge of the screw cap is either flush with the edge of the sealing foot, or occludes or lies below the lid surface, or, having a projecting edge, lies on the edge of the container opening On such a screw cap there is usually a flip-up ring-pull which, once flipped up, can be gripped in order to pull the screw cap together with the pouring spout out of the container opening to expand the bellows outwards.

Additionally, closures are known which are without bellows in which a corresponding cylindrical connection piece with an external thread is directly inserted into the container opening or is directly connected to a corresponding sealing foot. Finally, so-called telescopic closures are also known, which are provided with a relatively long, rigid pouring spout, the top and bottom ends of which are each provided with catches or stops so that this spout can be axially pushed into the container opening and is pushed as far as possible inside the container opening, for storage and transport and pulled out as far as possible for pouring and emptying the container, wherein both final positions are fixed by corresponding catch elements or stops.

In order to achieve as efficient manufacturing as possible, containers and container lids and closures are manufactured separately, often even in completely different manufacturing plants. The reason for this is, above all, that the permissible tolerances for the closures are generally substantially less than the permissible tolerances for the containers themselves. Only the opening in the lid of the container, in which the closure has to be inserted, has to be manufactured sufficiently accurately so that the closure can be inserted in a sealing manner into the opening. The sealing foot directly touching the edge of the container opening or the internal surface of a container neck is generally configured so that despite any differences in the measurements of the container opening or of the container neck, mechanically stable and at the same time leak-proof seating can still be achieved. The sealing foot is therefore composed of a relatively flexible, elastic material with catches, sealing lips and/or similar devices which should ensure on the one hand stable seating and on the other hand closure in a sealed manner. This is not only to guarantee a high degree of sealing and mechanical stability of the closure, even during later use, but also to guarantee these properties during storage and transport, until transferred to the consumer. When large quantities of containers are transported, they can for example fall off of shelves or palettes and thereby be subjected to relatively high mechanical stresses. Furthermore, the risk of some form of tampering with the container contents absolutely has to be avoided, whether it is substituted, has foreign substances added to it or is simply partly or completely removed.

In order to fill the requirements described above, the container openings concerned and also the corresponding closures often have had to be configured in a very complex manner. As already mentioned, plastic containers usually have a cylindrical screw connection piece upon which an additional external closure cap is screwed in order to retain the sealing foot on the container neck or the container opening. With the screw connection, the screw cap must additionally be prevented from loosening and it is generally connected by means of tearable tabs to an inner screw cap and/or a pull-ring with which the inner screw cap and the pouring spout connected thereto can be pulled out of the container neck. Although more simple configurations of closures are known, the use thereof is limited to metal packaging or containers with a metal lid which have an opening which can be punched out relatively accurately with simple means, wherein the edge of the opening can, where appropriate, also be formed by punching, and die tools. The edge of such container openings is substantially more difficult to deform than the edge of corresponding openings on plastic containers, so that for containers with metal lids comparatively simple configured closures can be relied on.

BRIEF DESCRIPTION OF THE INVENTION

The invention comprises a plastic screw cap for a closure for a lid of a plastic container. The cap is provided with a pull-ring and at least one extension extending outwards over a side of the cap. The extension is positionable proximate the lid and the extension is composed or a material which can be welded to material of the lid of the container in which the closure is arranged.

An extension is desirably provided on at least two diametrically opposite sides of the screw cap and preferably the cap is provided with three extensions each offset by 120 ° in relation to one another arranged along the periphery of the screw cap. The pulling is connected with a nestable pouring spout so that upward movement of the pull-ring will pull out the nestable spout.

DETAILED DESCRIPTION OF THE INVENTION

Figure 1:
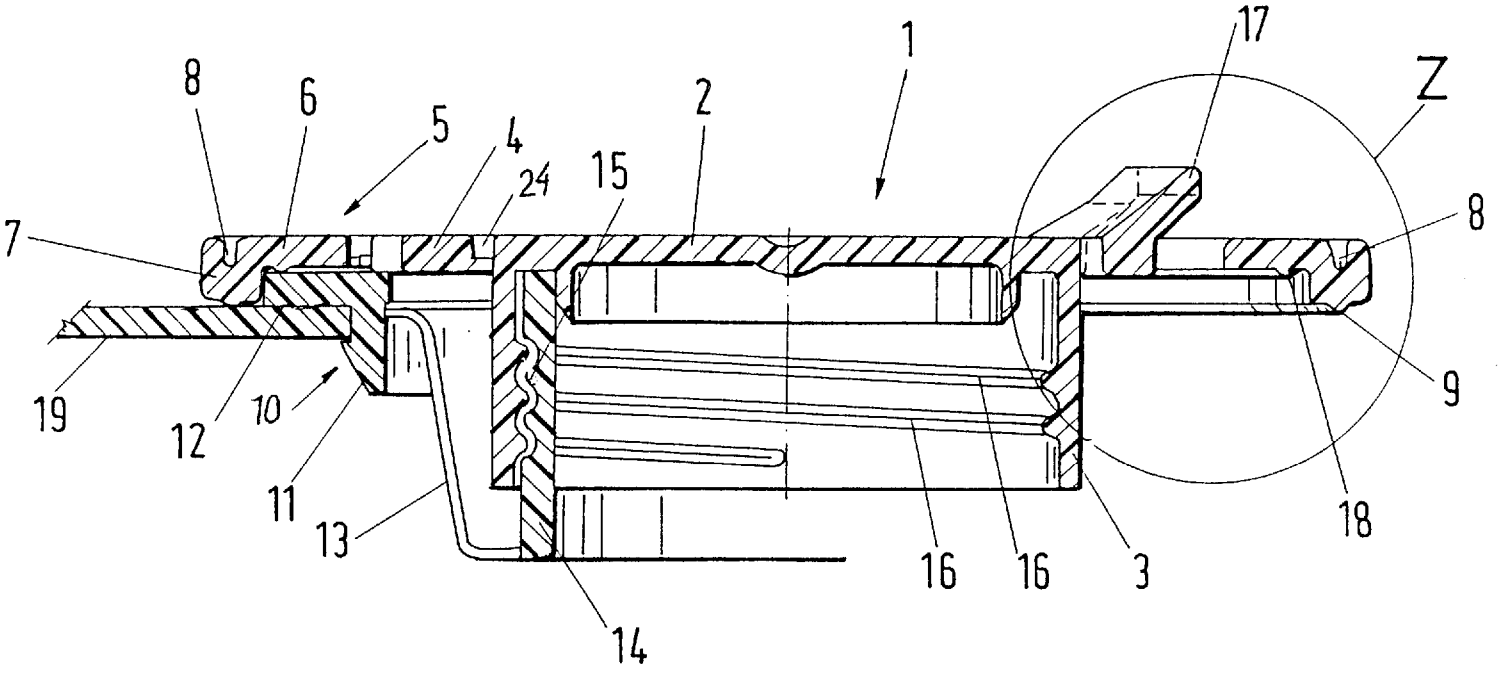
FIG. 1 shows a section, including the axis of the closure, through a bellows closure fitted in a container opening.

The present invention is basically usable on all the previously described embodiments, wherein the preferred area of use is with the previously described bellows closures and the telescopic closures.

With respect to the state of the art, the object of the present invention is to provide a closure, and in particular a screw cap made of plastic material for the closure of a plastic container which has a simple configuration similar to that of corresponding closures for metal containers, but nevertheless ensures stable and sealed seating of the closure on the container opening.

This is solved, according to the invention, by means of a screw cap for the closure, which is provided with an extension extending radially outwards over the side of the screw cap and/or a ring-pull fitted onto the cap, which is composed of a material which can be welded to the container lid.

In this way it is possible to weld the extension concerned to the lid of the plastic container to that the screw cap is connected in a fixed manner to the lid of the container, so that all other parts of the closure located under the cap and the extension are also securely fixed to the edge of the container opening. Welding ensures that even when the container falls over, the closure cannot simply fall off the container lid or become loose. Tampering is also impossible as the closure cap cannot be moved because of the extension firmly welded onto the lid, and the other parts of the closure are also not accessible, or at least cannot be removed without also separating the connection between the extension and the screw cap.

Within the meaning of the present invention a "lid" generally refers to that part of the container which immediately surrounds the container opening, even when this container opening is, for example, not on the top of the container but instead arranged more or less laterally in the proximity of the top edge of a container or also on an inclined surface connecting the top and side surfaces.

Naturally the radial length of the extension must be sufficient to ensure contact and a welded connection between the extension and the lid material. The radial extension must thus extend beyond the edge of the container opening, and insofar as this edge is covered by any of the parts of the closure, such as a sealing foot, for example, beyond the radial outer edge of such a sealing foot.

Advantageously at least one extension is arranged on each of two diametrically opposite sides of the screw cap, in order to prevent pulling off of one side of the cap or of the whole closure. Three extensions can also be arranged, offset by 120° from each other, along the external periphery of the cap or a pull-ring surrounding the cap. The number of extensions can also be increased, wherein an embodiment is generally preferred in which the extension is composed of one or more ring-sections.

An embodiment of the invention is particularly preferred in which the extension mentioned is configured as a substantially completely continuous ring. In this way the screw cap can be fixed to the container lid along its entire periphery by means of the extension, in that the extension is welded to the container lid.

In detail, according to the preferred embodiment, the continuous ring, is provided with a specific cross-section structure which can be simply described as a ring washer or annular flange-like park on the outer edge of which there is a bead-like thickening. With this, this bead extends in the axial direction predominantly only to one side, that being the side of the extension ring facing the lid. On the top, a continuous groove is provided in this beaded area in the extension ring in which an ultra-sound welding tool (sonotrode) can be inserted, while on the underside, at the same radial distance from the center as the groove, a downwardly tapering annular projection is provided which serves as a so-called direction guide. This projection ensures a narrow, approximately linear contact surface on the lid of the container along which the ultra-sound energy is concentrated in the case of ultra-sound welding. Such projections on plastic parts are usually called "direction guides" or "energy direction guides", because they concentrate the ultra-sound energy in a specific direction, namely from the contact point to the adjacent plastic part where the welding, has to take place.

As the bead is relatively thick and could possibly prevent effective transfer of the ultra-sound energy for welding, in the top of the bead section the groove for receiving a sonotrode is provided exactly above the energy direction guide, so that the distance is reduced between the sonotrode and welding point (i.e., the point of the energy direction guide).

When the screw cap is used together with a closure with a sealing foot with an annular flange-like part covering the edge of the opening, it is advantageous that the axial distance of the bead-like thickening with respect to the ring washer of the extension ring corresponds approximately to the thickness of the flange part of the sealing foot, and that the extension ring is dimensioned so that its bead section lies radially outside the flange part of the sealing foot. In this way, it is ensured that the beaded section can be welded to the lid radially outside the sealing foot and that the ring washer part of the extension ring lies on top of the flange part of the sealing foot Another continuous annular projection on the underside of the ring washer part, which presses the flange part of the sealing foot up onto the edge of the container opening, has additionally shown itself to be advantageous. Such a projection can press more or less deeply into the relatively soft material of such a sealing foot and thus also even out any tolerances and at the same time ensure engagement of the sealing foot in a stable and sealed manner with the edge of the container opening.

When a ring-pull lying within the extension is used for pulling up the screw cap and the pouring spout screwed thereupon, it has been found to be advantageous to provide the ring-pull with a grip tongue projecting above the plane of the top of the cap in which the extension ring preferably also lies. When the grip tongue projects above the plane of the extension ring and the top of the cap, it is easier to grip the ring-pull which can be curved upwards by lifting the grip tongue. Any tabs which connect the ring-pull on the one hand to the top of the cap, and on the other hand to the extension ring where appropriate, may thus be tom off or tom apart. Furthermore, the extension ring can instead be directly connected to the screw cap, i.e., to the top or side of the screw cap, by means of tearable tabs which tear only when the screw cap is pulled out from its collapsed state in the container opening with the aid of the ring-pull.

In an embodiment with a raised grip tongue on a ring-pull, there should be clearance available underneath the ring-pull which allows the ring-pull to be elastically pressed down so that the upper edge of the grip tongue fits substantially flush with the top surface of the screw cap. Lumped loads over the projecting grip tongues can be prevented in this way when a plurality of containers are stacked on top of one another.

The screw cap and extension ring, as well as the container lid are preferably composed of polypropylene. This material has sufficient stability and rigidity for the container as well as for the screw cap.

Further advantages, features and possibilities for use of the present invention will be made clear with the aid of the following description of the following preferred embodiments and the drawings associated therewith.

FIG. 1 shows a bellows closure consisting of a screw cap 1 and a lower closure part 10. The lower closure part 10 itself has a sealing foot with an L-shaped cross-section, wherein one arm 11 of the L defines an axially extending short, cylindrical connection piece, which is inserted in an opening of the lid 19 of a container, while the second aim 12 of the L defines an annular flange, which lies on the edge of the opening in the container lid 19. The sealing foot is connected by means of a bellows 13 to a pouring spout 14 which has an external thread 15 onto which the screw cap 1 is screwed by means of its internal thread 16.

Figure 2:
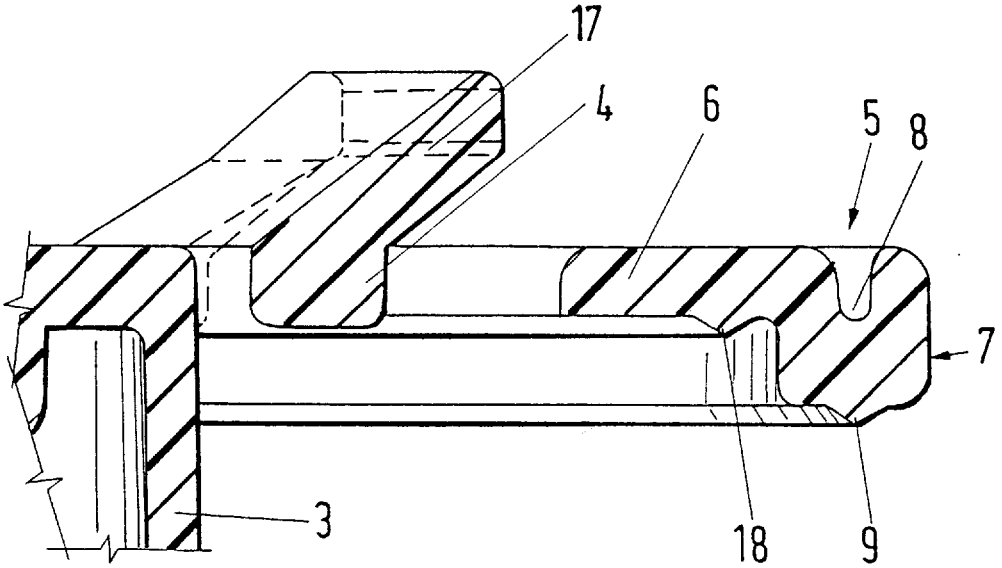
FIG. 2 shows a view from above of a closure cut in half along one diameter.

The screw cap 1 is essentially composed of a screw cap side 3 provided with the internal thread 16, a top 2, a ring-pull 4 and an extension in the form of extension ring 5 The extension ring, 5 itself has a specific cross-section profile which can be seen more clearly in FIG. 2. In detail, the extension ring 5 is composed of a ring washer section or ring washer part 6 and an outward facing bead part 7. The bead part 7 projects axially downwards and itself has in cross-section a V-shaped point or projection 9 which serves as an energy direction guide. Above this continuous, annular energy direction guide 9 a continuous annular groove 8 is provided in the top of the extension ring 5 in which a sonotrode can be inserted, with the aid of which the projection or energy direction guide 9 can be welded to the material of the lid 19.

The ring washer part 6 of the extension ring 5 also has a continuous, annular projection 18, which is V-shaped in cross-section which, however, is not to be welded to the underlying material. but instead, as can be seen on the left-hand side of FIG. 1, presses on the annular flange part 12 of the sealing foot and thereby ensures stable and sealed seating of the sealing foot on the edge of the container opening. As shown furthermore in FIG. 1, the axial projection of the bead part 7 with respect to the underside of the ring washer part 6 is of the same order of size as the thickness of the annular flange 12. In this way the simultaneous engagement of the bead with the lid (by welding) and of the projection 18 with the top of the flange part 12 is ensured. Because of its V-shaped cross-section, the projection 18 can be pressed more or less deeply into the generally relatively soft material (generally polyethylene) of the sealing foot or of the flange part 12 of the sealing foot.

As can be seen in FIG. 2, the ring-pull is provided with an upright grip tongue 17, while the ring-pull 4 itself lies in the same axial plane as the top 2 of the screw cap 1 and the ring washer shaped part 6 of the extension ring 5.

As shown on the left-hand side of FIG. 1, the ring-pull 4 Lies radially, clearly within the sealing foot, so that the ring-pull (also in mirror-image on the right-hand side of FIG. 1) can be moved freely downwards.

As shown in FIG. 2, there is nothing to prevent the elastic bending up of the ring-pull 4 in the area of the section plane shown as the tear-off tabs with which the ring-pull is connected on the one hand to the screw cap, and on the other hand to the extension ring 5. are arranged well outside this section plane, that is to say at a distance, in the direction of the periphery, from the upright grip tongue 17, and indeed preferably in the proximity of a solid tab 22 which forms an anchor point, with hinge points 24, for two symmetrically arranged ring-pulls 4.

Figure 3:
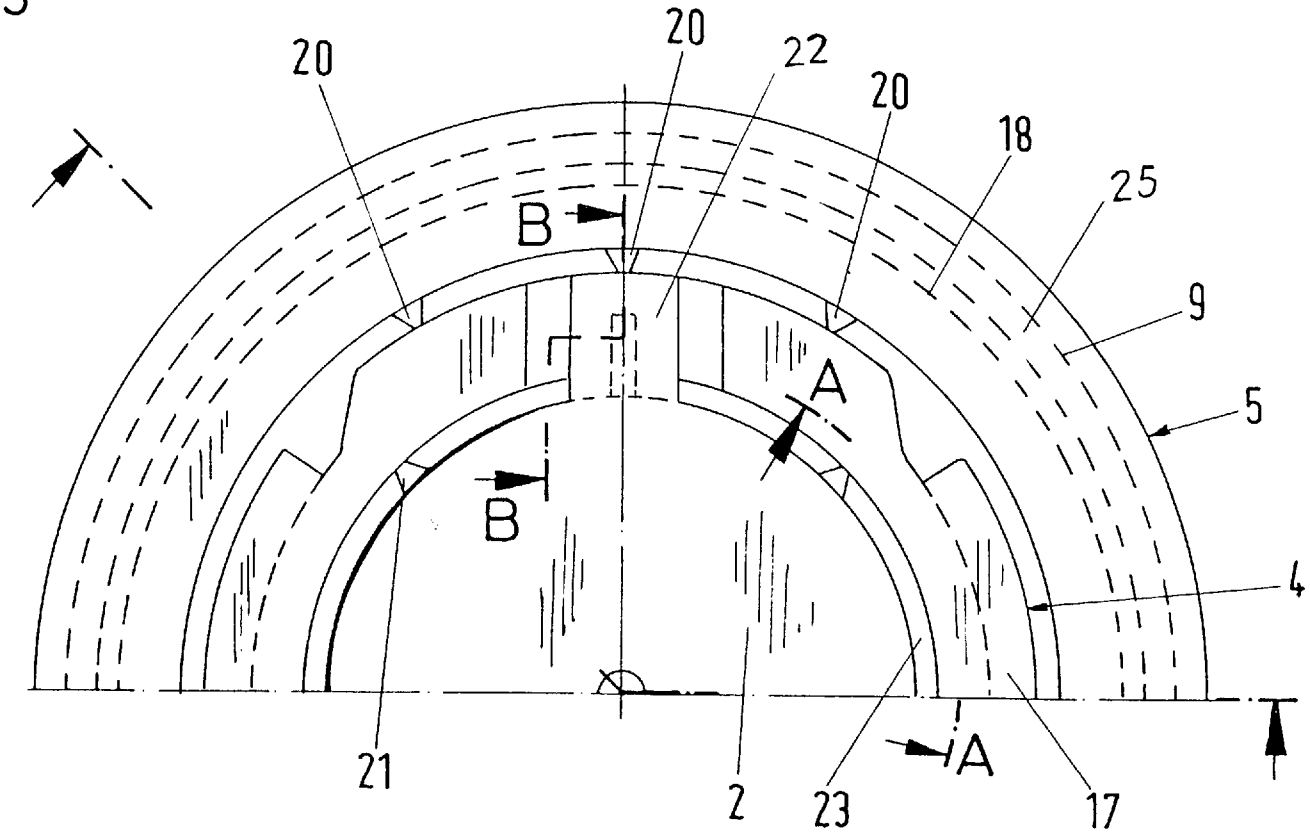
FIG. 3 shows a detailed view corresponding to the content of the circle Z in FIG. 1.

FIG. 3 shows the described closure form above and, going, from the inside to the outside the top 2 of the screw cap 1 can firstly be seen, and following this a gap 23 between the ring-pull 4 and the top 2 of the cap, wherein this gap f3 is bridged by a solid tab 22, lying diametrically opposite to which there is a further identical tab (not shown). On both sides of this tab a ring-pull 4 is connected by means of a hinge point 24 which is formed from a section with a less strong wall, after which there follows another gap. In the proximity of the solid tab 22 small, tearable tabs 21 form the connection between the ring-pull and the top 2 of the cap, while the ring-pull 4 or tab 22 is. connected to the extension ring 5 by means of further small, tearable tabs 20. The dashed lines in the area of the extension ring show, from the inside to the outside, the positions of the projection 18, the transition 25 from the ring washer part 6 to bead 7 and the energy direction guide 9.

The axially upward facing grip tongue 17 can be pressed down in the free space or cap between the top 2 of the screw cap and the extension ring 4, wherein it can be seen from FIG. 1 that under the ring-pull 4 there is always sufficient room to receive the pressed-down ring-pull, so that the top edge of the grip tongue 17 lies approximately flush with the surface of the top and of the extension ring 5 when, for example, a plurality of containers are stacked on top of one another, and pressure is thereby exerted in the grip tongue 17. With this, the ring-pull 4 is elastic enough so that when the pressure of containers or the like stacked thereupon is released, the ring-pull again resumes the initial position shown in FIG. 1.

Figure 4:
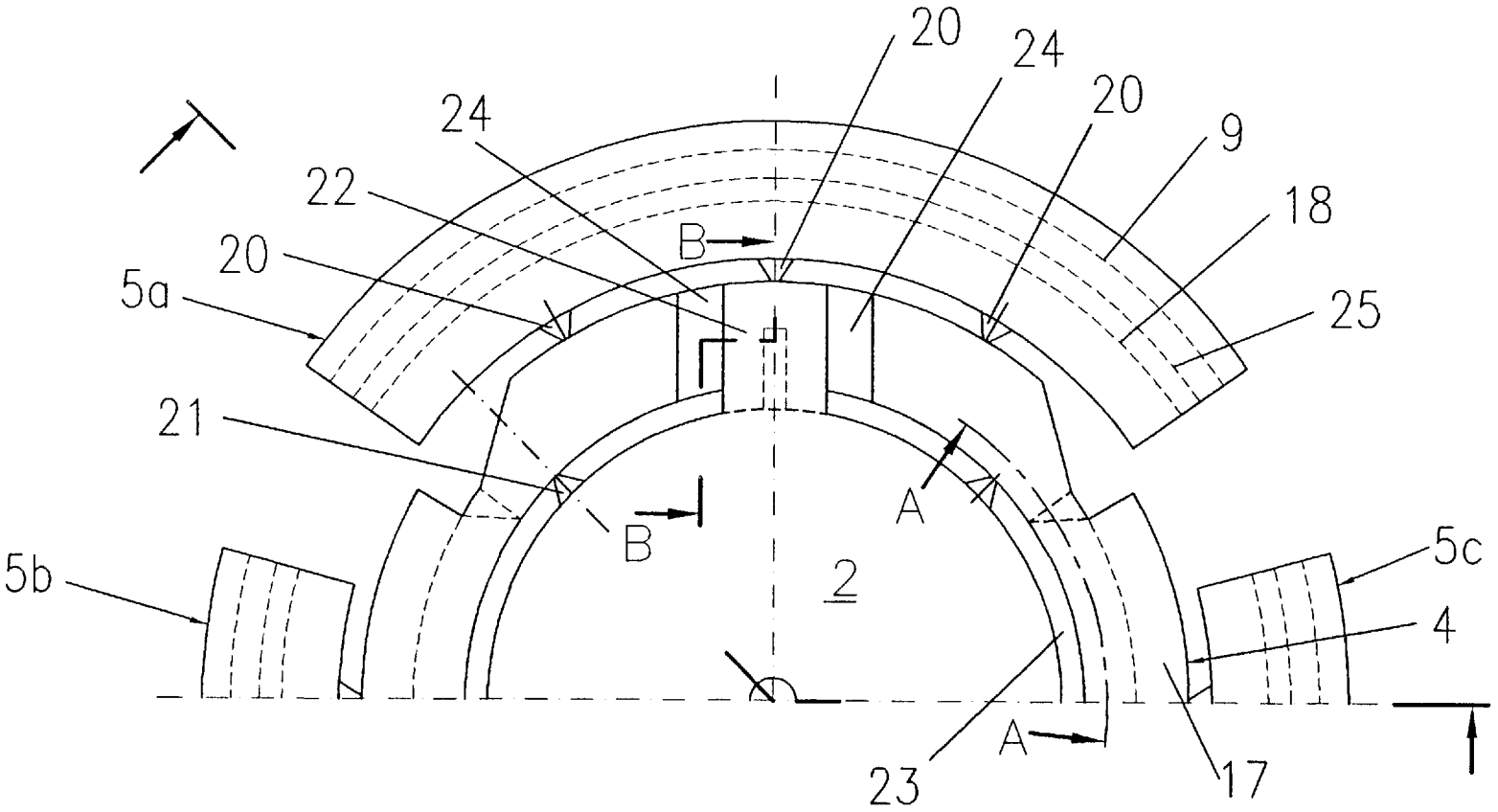
FIG. 4 shows an alternative embodiment having three extensions with a 120°offset with a view similar to FIG. 3.

FIG. 4 shows an alternative embodiment wherein three extensions 5*a*, 5*b* and 5*c*are provided spaced at 120°.

I claim:

1. A two part plastic closure for use on an opening in a container surface, said closure comprising:

a) a lower closure part including:

i) a pouring spout having a thread; and ii) a sealing foot for engagement with said opening, said sealing foot having a flange for contact with the container surface surrounding said opening said sealing foot being integrally connected with said pouring spout; and b) a screw cap in engagement with the thread of said pouring spout, wherein the screw cap is provided with an extension which is at least partially covering and radially extending over the flange of said sealing foot, said extension being provided for and adapted to be welded to the material of the surface of said plastic container wherein said extension is integrally connected to said screw cap by means of easy tearable tabs and completely separable therefrom by breaking said tabs.

2. A two part plastic closure according to claim 1 wherein a bellows is provided extending between said flange and said pouring spout in order to define a nestable pouring spout closure.

3. A two part plastic closure according to claim 2 wherein a pull-up ring is partly interposed between said extension and said screw cap.

4. A two part plastic closure according to claim 1 wherein a pull-up ring is partly interposed between said extension and said screw cap.

5. A two part plastic closure according to claim 1 wherein said extension is provided in the shape of a ring completely surrounding the screw cap and any pull-up ring connected thereto.

6. A two part plastic closure according to claim 1 wherein said extension is provided in the shape of segments of an interrupted ring surrounding said screw cap and any pull-up ring connected thereto.

7. A container comprising the two part closure of claim 1 wherein the extension of the screw cap is welded to both the flange of the foot and to the surface of the container.

8. The container of claim 7 wherein the surface of the container comprises the surface of a lid for the container.

9. A plastic container having an aperture into which a two part plastic closure is fitted, said closure comprising:

a) a lower closure part including:

i) a pouring spout having a thread; and ii) a sealing foot having a flange and being integrally connected to said pouring spout, said sealing foot being provided to engage the edge of a receiving aperture of a plastic container into which said closure is to be fitted; a screw cap in engagement with the thread of said pouring spout, wherein the screw cap is provided with an extension which is partially covering and radially extending over the flange of said sealing foot, said extension being welded to the material of said plastic container adjacent to said flange, wherein said extension is integrally connected to said screw cap by means of easy tearable tabs and completely separable therefrom by breaking said tabs.

10. A plastic container lid having an aperture into which a two part plastic closure is fitted, said closure comprising:

a) a lower closure part including:

i) a pouring spout having a thread;

ii) a sealing foot having a flange and being integrally connected to said pouring spout, said sealing foot being provided to engage the edge of a receiving aperture of a plastic container lid into which said closure is to be fitted;

iii) a screw cap in engagement with the thread of said pouring spout, wherein the screw cap is provided with an extension which is partially covering and radially extending over the flange of said sealing foot, said extension being welded to, the material of said plastic container lid, wherein said extension is integrally connected to said screw cap by means of easy tearable tabs and completely separable therefrom by breaking said tabs.

* * * * *